US008215537B2

(12) United States Patent
Makofsky

(10) Patent No.: US 8,215,537 B2
(45) Date of Patent: Jul. 10, 2012

(54) EXPANDABLE HOLDER

(75) Inventor: Marvin A. Makofsky, Sands Point, NY (US)

(73) Assignee: Conformer Products, Inc., Great Neck, NY (US)

( * ) Notice: Subject to any disclaimer, the term of this patent is extended or adjusted under 35 U.S.C. 154(b) by 2088 days.

(21) Appl. No.: 10/896,449

(22) Filed: Jul. 22, 2004

(65) Prior Publication Data

US 2006/0016862 A1 Jan. 26, 2006

(51) Int. Cl.
*B65D 27/00* (2006.01)

(52) U.S. Cl. ..... 229/67.3; 229/928

(58) Field of Classification Search ..... 229/67.3, 229/928

See application file for complete search history.

(56) References Cited

U.S. PATENT DOCUMENTS 1,448,875 A * 3/1923 Simpson ..... 281/19.1
3,125,279 A * 3/1964 Watts et al. ..... 229/117.06
3,870,223 A * 3/1975 Wyant ..... 229/72
D299,932 S * 2/1989 Beleckis ..... D19/26
5,598,969 A 2/1997 Ong
5,799,862 A * 9/1998 Gray ..... 229/68.1
5,921,463 A * 7/1999 Boyle et al. ..... 229/72
6,116,651 A * 9/2000 Makofsky et al. ..... 281/29
6,193,147 B1 * 2/2001 Schluger ..... 229/67.3
6,227,444 B1 * 5/2001 Makoesky et al. ..... 229/313
6,354,486 B1 * 3/2002 Ho ..... 229/67.3
6,461,070 B2 * 10/2002 Rew ..... 402/60
6,666,610 B1 12/2003 Moor

FOREIGN PATENT DOCUMENTS

DE 29918201 U1 * 12/1999

* cited by examiner

*Primary Examiner* — Nathan J Newhouse
(74) *Attorney, Agent, or Firm* — Francis C. Hand; Carella, Byrne et al.

(57) ABSTRACT

The pad holder is constructed with an expandable pocket to receive a pad of paper or the like and with a fold over front ply to retain the pad of paper in place. A pad of paper may be retained wholly within the pocket while the front ply is secured to the pocket to retain the pad in a secure condition. In another embodiment, the expandable holder is formed to receive photo prints.

17 Claims, 4 Drawing Sheets

EXPANDABLE HOLDER

This invention relates to an expandable holder. More particularly, this invention relates to an expandable holder for use as a stationery pad holder, an envelope for photoprints and other similar uses.

As is known, expandable folders had been known from U.S. Pat. No. 6,116,651 and expandable envelopes had been known from U.S. Pat. Nos. 6,227,444 and 6,564,994. The folders and envelopes described in these patents have pockets for receiving materials such that when the pockets become stuffed with materials, such as multi-page documents, the pockets are allowed to expand while narrowing in overall width. The construction of the pockets is such that the corners of the pockets are sealed over at all times.

In one embodiment, the present invention is directed to a pad holder that has an expandable pocket. This pad holder may be used to hold the backing of a stationery pad in place while the user is allowed to write on the pages of the pad. In addition, when not in use, the entire pad may be placed in the expandable pocket and closed over.

In brief, the pad holder is comprised of a back ply, a pair of side flaps at opposite sides of the back ply, a flap extending from a bottom edge of a back ply in overlying relation to the side flaps and a front ply secured to and extending from a top edge of the back ply in overlying relation to the pocket.

The back ply is formed with a horizontally disposed score line spaced from a bottom edge, a horizontally disposed score line spaced from the top edge and a vertically disposed score line spaced from each side edge. In addition, angularly disposed score lines extend from an intersection of a horizontally disposed score line and a vertically disposed score line towards a respective corner of the ply.

Each side flap is folded over the back ply along the fold line and includes a score line spaced from and parallel to this fold line.

The flap is secured to the side flaps between the score lines of the side flaps in order to define a pocket of a height less than the height of the back ply. This flap also has a score line spaced from and parallel to the bottom edge whereby upon insertion of materials into the pocket, the flap and back ply are expandable from each other to enlarge the thickness of the pocket while decreasing the width of the pocket.

In one embodiment, the front ply has a score line spaced from and parallel to the top edge to permit the front ply to fold thereat. In addition, in this embodiment, the back ply also has a second score line spaced from and parallel to the top edge that is coincident with the score line in the front ply in order to permit the back ply to fold thereat. In this embodiment, when a pad or other materials are stuffed into the pocket of the pad holder, the front and back plies fold about the respective score lines to accommodate the upper edges of the material stuffed into the pocket.

The pad holder is also provided with suitable means for either releaseably securing the front ply to the flap or for fixedly securing the front ply to the flap. For example, in one embodiment, VELCRO® hook and loop fastener elements may be provided to allow a releasable closure of the front ply onto the flap in order to seal the contents of the pocket. Where a fixed securement is required, depending upon the usage of the pad holder, an adhesive may be used to fixedly secure the front ply to the flap.

The pad holder may be made in different sizes. For example, in one embodiment, the pad holder is sized so as to receive a pad of papers of 8½×11" size. In this embodiment, the height of the pocket is less than half the height of the back ply.

In another embodiment, the flap forming the pocket is of a height that is a major fraction of the height of the back ply. In this embodiment, only a minor fraction of the material stuffed into pocket would be exposed when the pad holder is in an opened condition.

In another embodiment of the present invention, the expandable holder is made as an envelope for receiving photo prints. In this embodiment, the back ply has a greater width than the height so that the pocket is of a width and height to receive photo prints. In accordance with this embodiment, the width of the pocket may be such as to receive panoramic prints.

In any of the embodiments, the flap may be a curvilinear upper edge to facilitate access to materials in the pocket. Likewise, each of the side flaps may have a contoured upper edge to merge into the upper edge of the flap.

In any of the embodiments, the flap may also have a window therein for viewing the contents of the pocket. The window may also be closed over by a piece of transparent material, such as cellophane or the like.

Where the pad holder is constructed to receive photo prints, a separate insert may be secured within the pocket in order to separate negatives from positive prints.

These and other objects and advantages of the invention will become more apparent from the following detailed description taken in conjunction with the accompanying drawings wherein.

Figure 1:
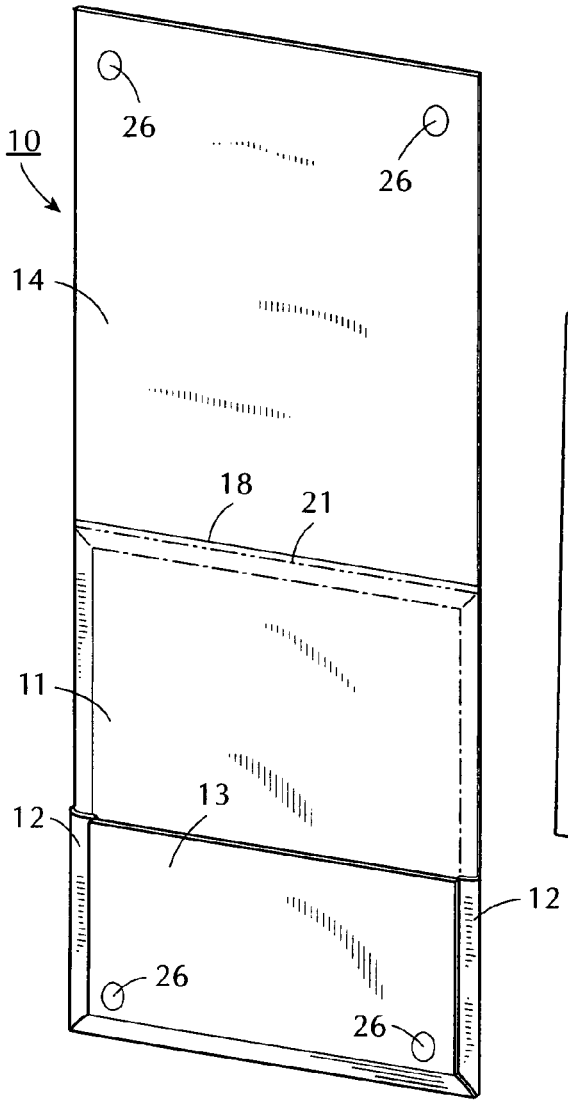
FIG. 1 illustrates a pad holder in an opened condition in accordance with the invention.

Referring to FIG. 1, the pad holder 10 includes a back ply 11, a pair of side flaps 12, a flap 13 and a front ply 14.

Figure 5:
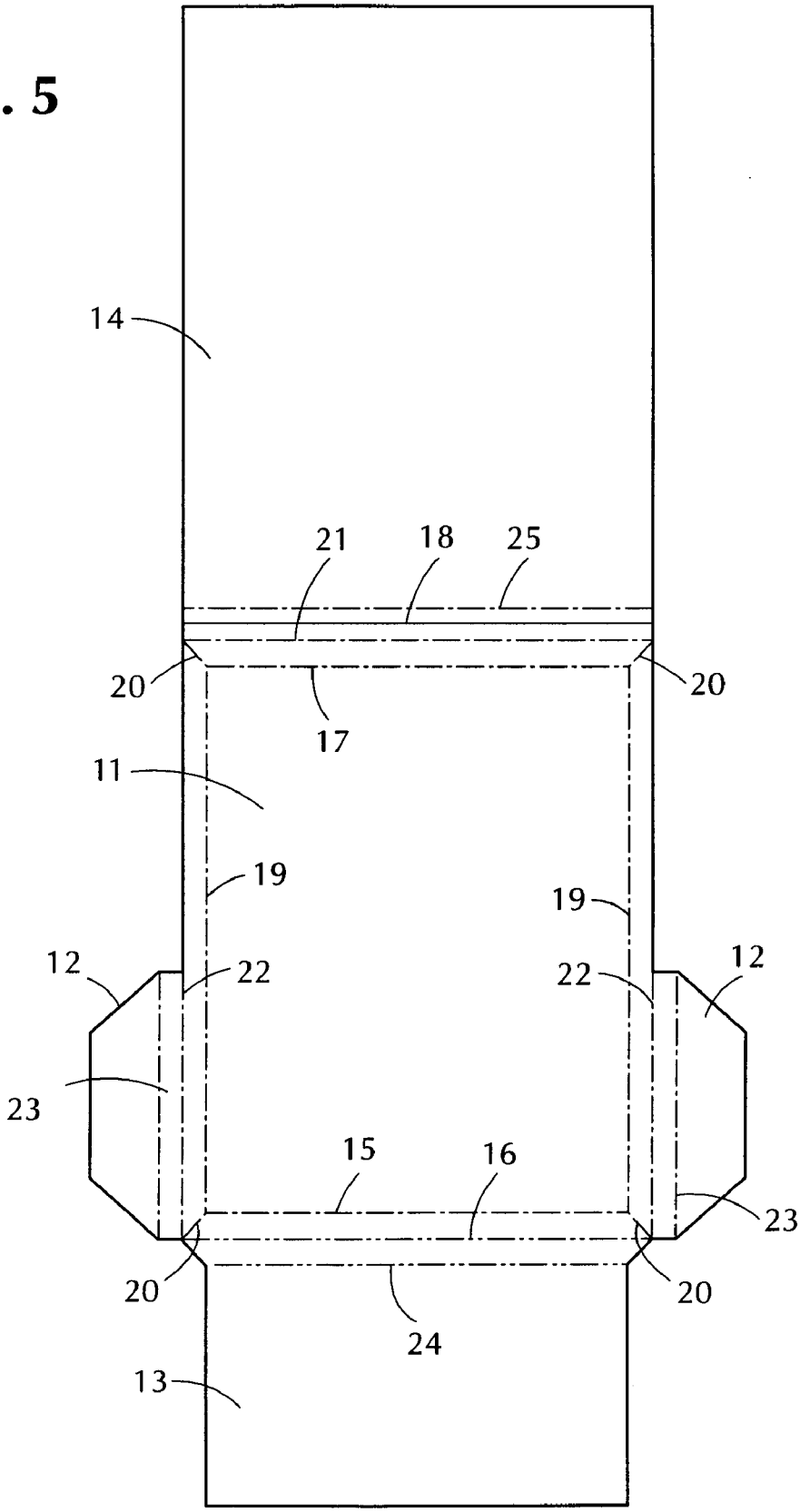
FIG. 5 illustrates a blank for making the pad holder of FIG. 1.

Referring to FIGS. 1 and 5, the back ply 11 has a horizontally disposed score line 15 spaced from a bottom edge 16 and a parallel horizontally disposed score line 17 spaced from a top edge 18. In addition, a vertically disposed score line is spaced from each side edge of the back ply 11 to intersect with a respective horizontal score line 15, 17. In addition, a plurality of angularly disposed score lines 20 extend from an intersection of a respective horizontal score line 15, 17 and vertical score line 19 towards a respective corner of the ply 11.

In the illustrated embodiment, the angularly disposed score lines 20 at the bottom of the flap 11 extend directly to the corner of the back ply 11 while the upper angularly disposed score lines 20 extend to a point on the side edge of the ply 11 that is spaced form the top edge 18.

In this embodiment, the back ply 11 is also provided with a second score line 21 that is spaced from and parallel to the top edge 18 to permit the back ply to fold thereat. This second score line 21 intersects with the respective angularly disposed score lines 20.

Each side flap 12 extends from an opposite side of the back ply 11 and is folded over the back ply 11 along a fold line 22. In addition, each side flap 12 has a score line 23 that is spaced from and parallel to the fold line 22. As illustrated, each side flap 12 is of rectangular shape between the fold line 22 and score line 22 while being of trapezoidal shape from the score line 23 to the terminal edge of the side flap 12. However, each side flap 12 may be of other shape depending upon the uses to which the pad holder 10 is placed.

The flap 13 extends from the bottom edge 16 of the back ply 11 in overlying relation to the back ply 11 as illustrated in FIG. 1. In addition, the flap 13 is secured to the side flaps 12 between the score lines 23 in order to define a pocket of a height less than the height of the back ply 11 as is illustrated in FIG. 1.

The flap 13 is provided with a score line 24 (see FIG. 5) that is spaced from and parallel to the bottom edge 16 whereby upon insertion of materials into the pocket, the flap 13 and back ply 11 are expandable from each other in order to enlarge the thickness of the pocket while decreasing the width of the pocket.

As illustrated in FIG. 5, the flap 13 has a trapeziodal section extending between the fold line 16 and the score line 24 that overlies the rectangular section of a side flap 12 to seal the corner of the pad holder 10 as illustrated in FIG. 1. The flap 13 also has a rectangular section that is of a width to fit between and be coincident with the score lines 23 of the side flaps 12.

Figure 2:
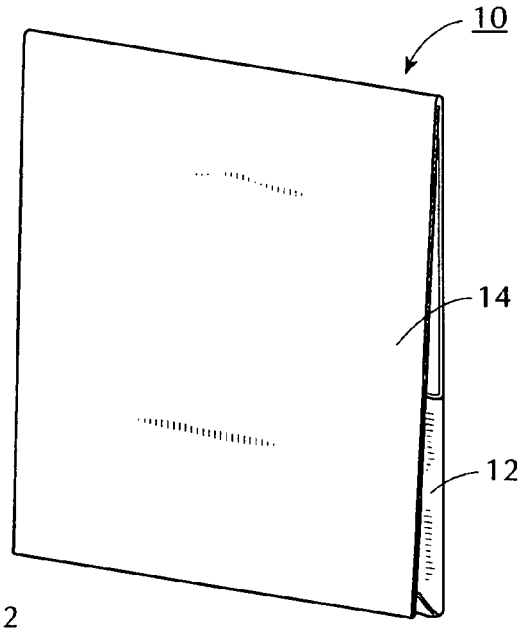
FIG. 2 illustrates the pad holder of FIG. 1 in a closed condition.
Figure 4:
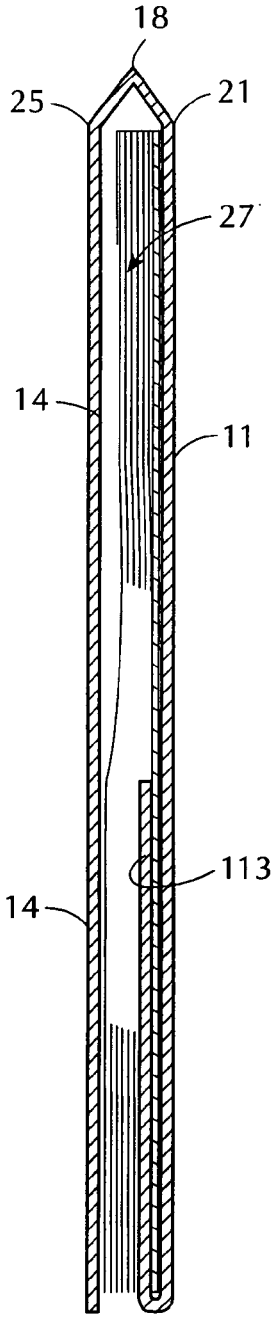
FIG. 4 illustrates a cross-sectional view of the pad holder in a closed position.

The front ply 14 is secured to and extends from the top edge 18 of the back ply 11 and is of a length to overly the flap 13 as illustrated in FIG. 2. The front ply 14 also has a score line 25 spaced from and parallel to the top edge 18 and that is coincident with the score line 21 in the back ply 11. The top edge 18 of the back ply 11 is defined by a fold line such that the fold line 18 and pair of score lines 21, 25 allow the top of the pad folder 10 to fold in a manner to accommodate the thickness of materials that are stuffed into the pocket and that extend up to the top of the pad folder 10. This is illustrated in FIG. 4.

Referring to FIG. 1, the pad folder 10 is also provided with suitable means 26, such as Velcro® discs, in order to allow the front ply 14 to be releaseably secured to the flap 13 and to thereby close over the materials stuffed into the pocket of the pad folder 10. Any other suitable means may be provided for releaseably securing the front ply 14 to the flap 13 or for fixedly securing the front ply 14 to the flap 13.

Figure 3:
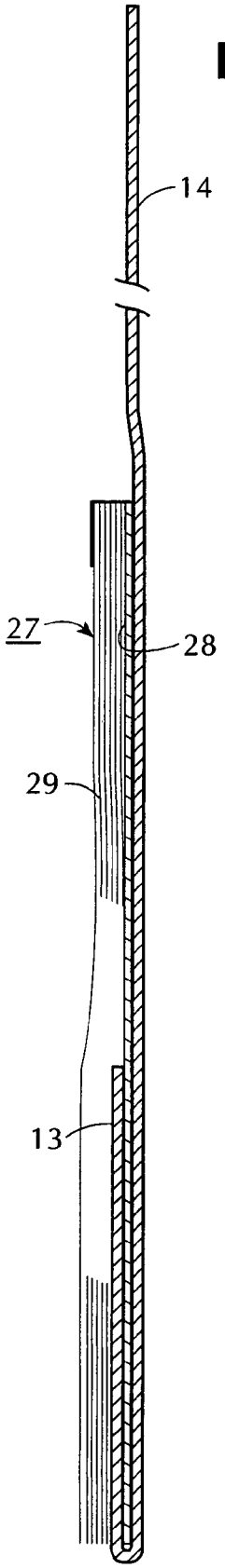
FIG. 3 illustrates a part cross-sectional view of the pad holder of FIG. 1.

When in use, a stationery pad 27 comprised of a stiff backing 28 and a plurality of sheets of paper 29 may be mounted in the pad holder 10 for writing use. For example, as illustrated in FIG. 3, the stiff backing 28 of the pad 27 is slid into the pocket between the flap 13 and the back ply 11 while the sheets of paper 29 are disposed outside the pocket so that a user may write on the sheets of paper 29. When the user has finished writing on the sheet or sheets of paper 29, the front ply 14 is closed over the pad 27 into a condition as indicated in FIG. 4 to protect the writing on the top sheet of paper.

Alternatively, the entire pad 27 may be stuffed into pocket defined between the flap 13 and back ply 11 and the front ply 14 then folded over to close about the pocket while being secured to the flap 13. Thus, the pad 27 may be transported in a totally enclosed condition.

As indicated in FIG. 5, the front ply 14 has a smooth uninterrupted surface but for the score line 25. In addition, the front ply 14 is of equal width to the back ply 11. Also, as indicated in FIG. 2, the front ply 14 is of equal height to the back ply 11.

Furthermore, as illustrated in FIG. 1, the side flaps 12 and the flap 13 are of equal height and the side flaps 2, the flap 13 and pocket are of a minor fraction of the height of the back ply 11.

Figure 6:
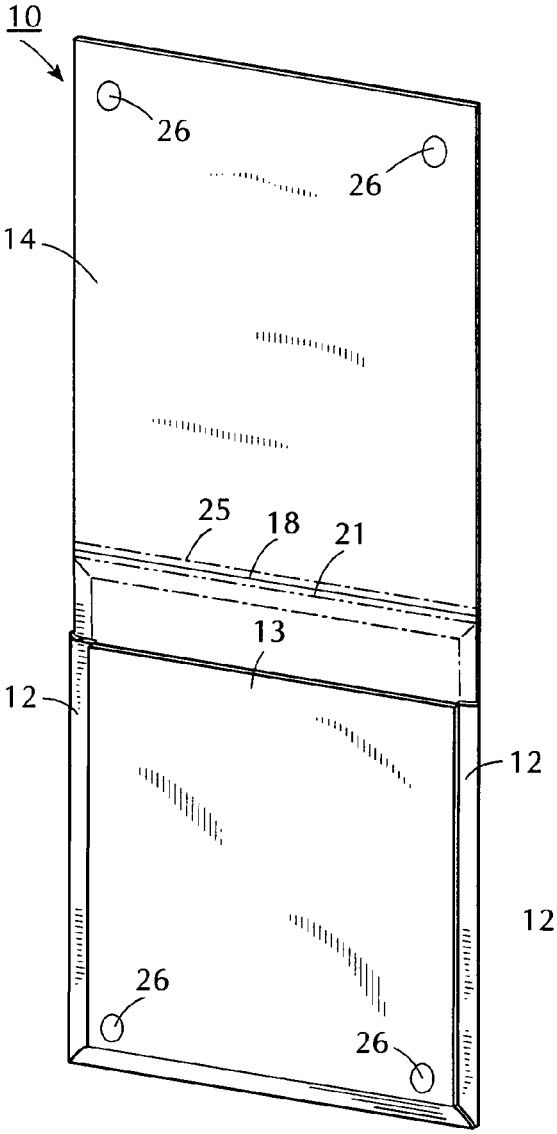
FIG. 6 illustrates a modified folder in accordance with the invention.

Referring to FIG. 6, wherein like reference characters indicate like parts as above, the side flaps 12 and flap 13 may be of a greater height than as shown in FIG. 1 so that the resulting pocket is of a major fraction of the height of back ply 11.

Figure 7:
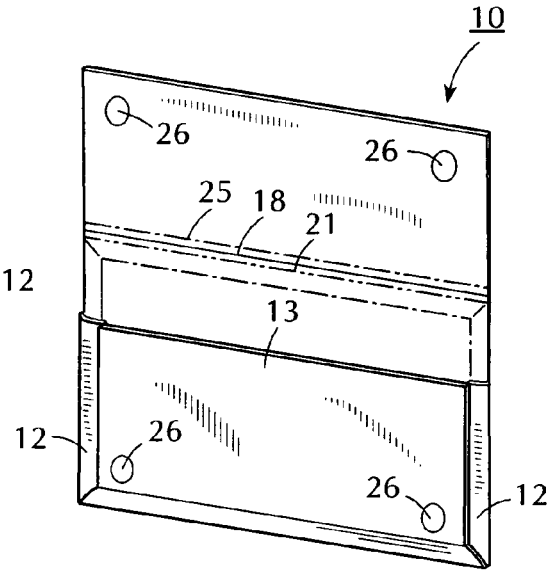
FIG. 7 illustrates a perspective view of an envelope for receiving photo prints in accordance with the invention.

Referring to FIG. 7, wherein like reference characters indicate like parts as above, the expandable holder 10' may be modified to form an envelope, for example for receiving photo prints.

In this embodiment, the envelope may be provided with an insert (not shown) in order to separate the pocket into one compartment for negatives and a second compartment for photo prints.

Typically, the envelope shown in FIG. 7 is made of a width wider than the height thereof to receive photo prints of conventional size. However, the envelope may also be made wider than as shown in order to receive panoramic prints.

The front ply 13 may also be provided with a curvilinear upper edge (not shown) in order to facilitate access to materials in the pocket. Likewise, each side flap 13 may have a contoured upper edge (not shown) to merge into the upper edge of the flap 13.

The invention thus provides a pad holder that is convenient for receiving a pad of paper in a manner that permits ease of writing as well as a manner for ease of storage.

The invention also provides an expandable envelope for receiving photo prints.

What is claimed is:

1. A pad holder comprising a back ply having a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line towards a respective corner of said ply;

a pair of side flaps at opposite sides of said back ply, each said side flap being of a height equal to a minor fraction of the height of said back ply and folded over said back ply along a fold line therebetween and including a score line spaced from and parallel to said fold line;

a flap extending from said bottom edge of said back ply in overlying relation to said back ply and secured to said side flaps between said score lines thereof to define a pocket of a height less than the height of said back ply, said flap being of a height equal to the height of each said side flap and having a score line spaced from and parallel to said bottom edge whereby upon insertion of materials into said pocket, said flap and said back ply are expandable from each other to enlarge the thickness of said pocket while decreasing the width of said pocket; and a front ply secured to and extending from said top edge of said back ply in overlying relation to said pocket.

2. A pad holder as set forth in claim 1 wherein said front ply has a score line spaced from and parallel to said top edge to permit said front ply to fold thereat.

3. A pad holder as set forth in claim 2 wherein said back ply has a score line spaced from and parallel to said top edge and coincident with said score line in said front ply to permit said back ply to fold thereat.

4. A pad holder as set forth in claim 1 wherein said front ply has a smooth uninterrupted surface.

5. A pad holder as set forth in claim 1 wherein said front ply is of equal width to said back ply.

6. A pad holder as set forth in claim 5 wherein said front ply is of equal height to said back ply.

7. A pad holder as set forth in claim 1 wherein said back ply has a second score line spaced from and parallel to said top edge and intersecting with a respective angularly disposed score line.

8. A pad holder as set forth in claim 7 wherein said front ply has a score line spaced from and parallel to said top edge and coincident with said second score line in said back ply to permit said front ply to fold thereat.

9. A pad holder as set forth in claim 1 further comprising means for releasably securing said front ply to said flap.

10. A pad holder as set forth in claim 1 further comprising means for fixedly securing said front ply to said flap.

11. An envelope comprising a back ply having a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line towards a respective corner of said ply, said back ply being of a greater width than height thereof;

a pair of side flaps at opposite sides of said back ply, each said side flap being of a height less than the height of said back ply and folded over said back ply along a fold line therebetween and including a score line spaced from and parallel to said fold line;

a flap extending from said bottom edge of said back ply in overlying relation to said back ply and secured to said side flaps between said score lines thereof to define a pocket of a height less than the height of said back ply, said flap being of a height equal to the height of each said side flap and having a score line spaced from and parallel to said bottom edge whereby upon insertion of materials into said pocket, said flap and said back ply are expandable from each other to enlarge the thickness of said pocket while decreasing the width of said pocket, said pocket being of a width and height to receive photo prints therein;

a front ply secured to and extending from said top edge of said back ply in overlying relation to said pocket, said front ply being of rectangular shape and being of equal width to said back ply and of equal height to said back ply; and means on said front ply for releasably securing said front ply to said flap.

12. An envelope as set forth in claim 11 wherein said front ply has a score line spaced from and parallel to said top edge to permit said front ply to fold thereat.

13. An envelope as set forth in claim 12 wherein said back ply has a score line spaced from and parallel to said top edge and coincident with said score line in said front ply to permit said back ply to fold thereat.

14. An expandable holder for a stationary pad having a stiff backing and a plurality of sheets of paper comprising a back ply having a horizontally disposed score line spaced from a bottom edge thereof, a vertically disposed score line spaced from one side edge thereof, a vertically disposed score line spaced from another side edge thereof and a plurality of angularly disposed score lines, each said angularly disposed score line extending from an intersection of said horizontally disposed score line and a vertically disposed score line towards a respective corner of said ply;

a front flap extending from said bottom edge of said back ply in overlying relation to said back ply and having a score line spaced from and parallel to said bottom edge in coincidence with said first horizontally disposed score line of said back ply; and a pair of side flaps securing said front flap to said back ply along opposite sides of said back ply, said side flaps being of a height equal to the height of said front flap to define a pocket of a height that is a minor fraction of the height of said back ply to receive a stiff backing of a stationary pad therein with the plurality of sheets of paper disposed outside said pocket, at least one of said side flaps being folded over said back ply along a fold line therebetween and including a score line spaced from and parallel to said fold line in coincidence with a respective vertically disposed score line of said back ply whereby upon insertion of the stiff backing and sheets of paper of the stationary pad into said pocket, said front flap and said back ply are expandable from each other to enlarge the thickness of said pocket while decreasing the width of said pocket.

15. An expandable holder as set forth in claim 14 wherein each of said side flaps is folded over said back ply along a fold line therebetween and includes a score line spaced from and parallel to said fold line in coincidence with a respective vertically disposed score line of said back ply.

16. In combination a stationary pad having a stiff backing and a plurality of sheets of paper; and an expandable holder including a back ply having a horizontally disposed score line spaced from a bottom edge thereof, a vertically disposed score line spaced from one side edge thereof, a vertically disposed score line spaced from another side edge thereof and a plurality of angularly disposed score lines, each said angularly disposed score line extending from an intersection of said horizontally disposed score line and a vertically disposed score line towards a respective corner of said ply; a front flap extending from said bottom edge of said back ply in overlying relation to said back ply and having a score line spaced from and parallel to said bottom edge in coincidence with said first horizontally disposed score line of said back ply; and a pair of side flaps securing said front flap to said back ply along opposite sides of said back ply, said side flaps being of a height equal to the height of said front flap to define a pocket of a height less than the height of said back ply to receive said stiff backing of said stationary pad therein with the plurality of sheets of paper disposed outside said pocket, at least one of said side flaps being folded over said back ply along a fold line therebetween and including a score line spaced from and parallel to said fold line in coincidence with a respective vertically disposed score line of said back ply whereby upon insertion of said stiff backing and said sheets of paper of said stationary pad into said pocket, said front flap and said back ply are expandable from each other to enlarge the thickness of said pocket while decreasing the width of said pocket.

17. The combination as set forth in claim 16 wherein each said side flap is of a height equal to a minor fraction of the height of said back ply.

* * * * *